US005937718A

United States Patent [19]

Granger

[11] Patent Number: 5,937,718

[45] **Date of Patent: *Aug. 17, 1999**

[54] FOLDED/UNFOLDED PAPER TOWEL DISPENSING APPARATUS

[76] Inventor: Maurice Granger, 17 rue Marcel Pagnol, 42270 Saint Priest En Jarez, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/793,531

[22] PCT Filed: Jul. 4, 1995

[86] PCT No.: PCT/FR95/00887

§ 371 Date: May 27, 1997

§ 102(e) Date: May 27, 1997

[87] PCT Pub. No.: WO96/06557

PCT Pub. Date: Mar. 7, 1996

[30] Foreign Application Priority Data

Aug. 29, 1994 [FR] France ..... 94 10669

[51] Int. Cl.[6] ..... B26D 1/56; A47K 10/36

[52] U.S. Cl. ..... 83/334; 83/337; 83/649; 225/96; 225/106

[58] Field of Search ..... 83/649, 334, 335, 83/337, 252, 250, 215, 646, 594, 339, 314, 352, 285; 225/106, 96, 39, 51, 53

[56] References Cited

U.S. PATENT DOCUMENTS

| | | | |
|---|---|---|---|
| 2,051,242 | 8/1936 | Birr et al. | 225/96 |
| 3,668,962 | 6/1972 | Chapman | 83/337 X |
| 3,998,120 | 12/1976 | Granger et al. | 83/649 X |
| 4,122,738 | 10/1978 | Granger | 83/337 X |
| 4,176,569 | 12/1979 | DeLuca et al. | 83/337 |
| 4,188,844 | 2/1980 | DeLuca et al. | 83/335 X |
| 4,339,092 | 7/1982 | Benoy et al. | 83/337 X |
| 4,621,755 | 11/1986 | Granger | 225/106 X |
| 4,635,837 | 1/1987 | Granger | 225/106 X |
| 4,712,461 | 12/1987 | Rasmussen | 83/337 X |
| 4,846,035 | 7/1989 | Granger | 83/337 |
| 5,048,386 | 9/1991 | DeLuca et al. | 83/37 |
| 5,078,033 | 1/1992 | Formon | 83/335 |
| 5,410,930 | 5/1995 | DeLuca et al. | 83/337 X |
| 5,441,189 | 8/1995 | Formon et al. | 83/337 X |

FOREIGN PATENT DOCUMENTS

| | | | |
|---|---|---|---|
| 0317448 | 5/1989 | European Pat. Off. . | |
| 2667854 | 4/1992 | France | 83/649 |
| 2701016 | 5/1994 | France . | |
| 2703343 | 10/1994 | France . | |
| 2713075 | 9/1995 | France . | |
| 2717789 | 9/1995 | France . | |
| 2723303 | 9/1996 | France . | |
| 2318356 | 11/1973 | Germany | 83/649 |
| 1482193 | 8/1977 | United Kingdom | 83/337 |
| 94/17715 | 8/1994 | WIPO . | |

*Primary Examiner*—Rinaldi I. Rada
*Assistant Examiner*—Boyer Ashley
*Attorney, Agent, or Firm*—Wall Marjama Bilinski & Burr

[57] ABSTRACT

An apparatus for safely controlling a paper cut-off device in a paper towel dispenser in which a knife of the cut off device can effectively be locked in a stop position within a recess of a drum. Alternatively, the apparatus can lock the knife in a position of initial rotation within the recess of the drum prior to ejection of the knife. The knife is locked in either of these positions by stopping mechanisms arranged on the lateral side of the housing of the towel dispenser at a location of a fixed cam with a plurality of radiating fingers, and near the end flange of the drum opposite a heel-shaped pinion, respectively. A rotation control mechanism disposed at the base of the housing ensures swiveling and retraction of the knife into the recess formed on the drum.

8 Claims, 5 Drawing Sheets

FOLDED/UNFOLDED PAPER TOWEL DISPENSING APPARATUS

FIELD OF THE INVENTION

This invention relates to the field of apparatus for dispensing cellulose wadding, creped paper towels and towels of similar materials, especially those used for wiping the user's hands, toilet paper and paper napkins.

BACKGROUND OF THE INVENTION

Paper towel dispensers with automatic cutoff devices in which the potential user seizes the paper band to obtain a length of paper are known in the art. For example, applicant has developed numerous paper dispensing apparatuses, such as those in French patent applications 93/04082, 93/14609, 94/04399, and 94/09924.

In these dispensers, the paper band is cut across its entire unfolded width, thus retaining its original width. The above described dispensers require a reduced number of parts, thereby allowing rapid field installation with no special tools. One particular variation dispenses cut paper in a folded form.

This dispenser comprises a housing featuring lateral flanges which permit the rapid drum installation. This dispenser's paper cutoff device and a tensioning device press down onto the drum. Both parts lock in position automatically when pressed home, thereby causing the paper band fed from a reel located in the upper housing to be tightened.

In the above-mentioned patents, the knife holder support is fixed on the lateral flanges of the drum. One end of the knife holder support is fitted with a pinion capable of cooperating with a cam with a plurality of radiating fingers formed on one of the sides of the housing. The cam and pinion cooperate to eject the knife. This pinion is internally adjacent to the flange opposite the drum. The pinion is also in a plane that is offset with respect to the flange in order to allow swivelling and movement of the knife in the different operating phases of the apparatus.

When the apparatus is not being operated (i.e., when a paper band is not being pulled), the knife is in a retracted position in the cavity formed transversely in the drum. The knife is situated on the front surface of the apparatus, opposite the protective cover. No component or particular means holds the knife in its recess other than the knife itself. Unfortunately, after removing the cover to load the dispenser, the knife may inadvertently project forward and cut the hand of an operator.

SUMMARY OF THE INVENTION

Accordingly, one object of the invention is to ensure protection of the operator by securing retention of the knife in the cavity formed in the drum without obstructing ejection of the knife during the active paper-cutting phase, and without comprising the accuracy and safety of the gearing mechanism.

Another object of the invention is to improve the quality of operation by silently dispensing the paper strips.

A further object of the invention is to provide each of the above advantages simultaneously.

Additional objects, advantages, and other novel features of the invention will be set forth in part in the description that follows and in part will become apparent to those skilled in the art upon examination of the following of the following or may be learned with the practice of the invention. The objects and advantages of the invention may be realized and attained by means of the instrumentalities and combinations particularly pointed out in the appended claims.

To achieve the foregoing and other objectives, and in accordance with the purposes of the present invention, an apparatus for dispensing paper towels is provided. The paper towel dispenser includes a protective housing; lateral flanges, in its upper part, for positioning of a reel holder; and, in its lower part, a drum devised to accommodate a paper cutoff device, and a tensioning device in contact with said drum, between which the tensioned material to be cut is threaded. The paper cutoff device is hinged relative to the drum to ensure cutting of the paper band pulled by the user. A means of actuating and reversing during rotation of the drum is included. In addition, a protective cover that is positioned and hinged at the base of the housing, and fixed by clicking it onto the housing by a locking means is included, as well as a cam with a plurality of radiating fingers which is fixed on the inside of the housing. This cam cooperates with a heel-shaped part which has teeth forming a pinion. This pinion is associated with the knife holder to ensure, in certain operating phases, ejection of the knife out of the drum.

In accordance with one important feature of the invention, the means for locking the knife in the drum are located in two different positions depending upon the position of the drum. That is, the means of locking the drum in its stop position is arranged on the lateral inside of the housing of the dispenser at the fixed cam with a plurality of radiating fingers. By contrast, the means of locking the drum in its position of initial rotation before ejection of the knife is arranged near the end flange of the drum opposite the heel-shaped part. In accordance with another important feature, an additional means is placed on the base of the housing which cooperates with the knife to ensure that knife swivels and retracts into the recess formed on the drum. As a result, the knife is secured in the recess formed on the drum without obstructing ejection of the knife during the paper-cutting phase, without compromising the accuracy and safety of the gearing mechanism. Advantageously, this prevents the knife from inadvertently projecting forward while loading the dispenser, thereby safeguarding the person loading one dispenser from an inadvertent cut.

BRIEF DESCRIPTION OF THE DRAWING

The object of the present invention is described, merely by way of example, in the accompanying drawings in which:

FIGS. 3, 3*a*, 3*b* and 3*c* are exploded perspective views before assembly of the various components that ensure the safety and retention in position of the knife in the gap formed in the drum.

DETAILED DESCRIPTION OF THE INVENTION

In order that the present invention may be more readily understood, the following description is given, merely by way of example, reference being made to the accompanying drawings.

Figure 1:
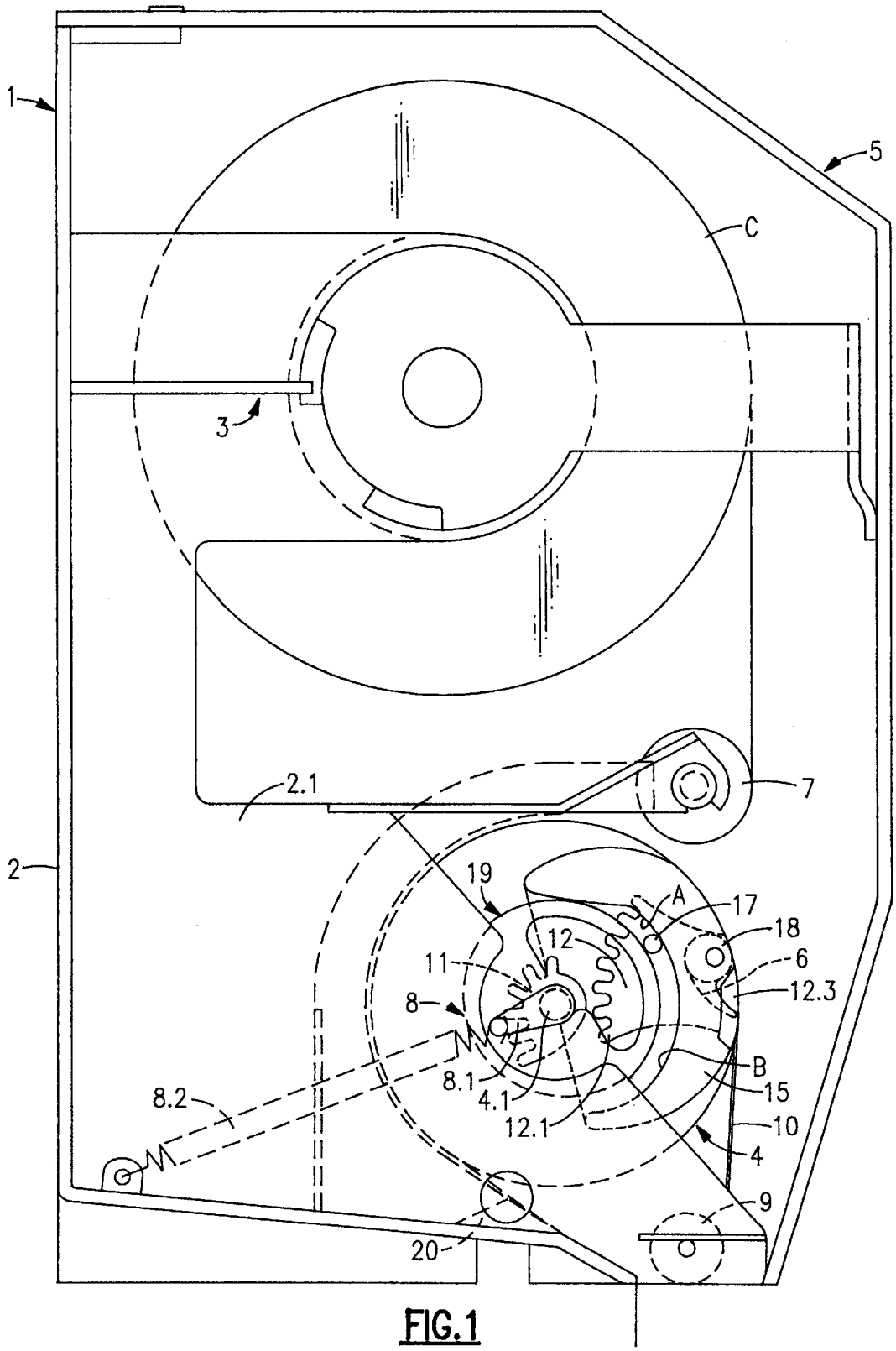
FIG. 1 is a side view of the apparatus according to the invention.
Figure 2:
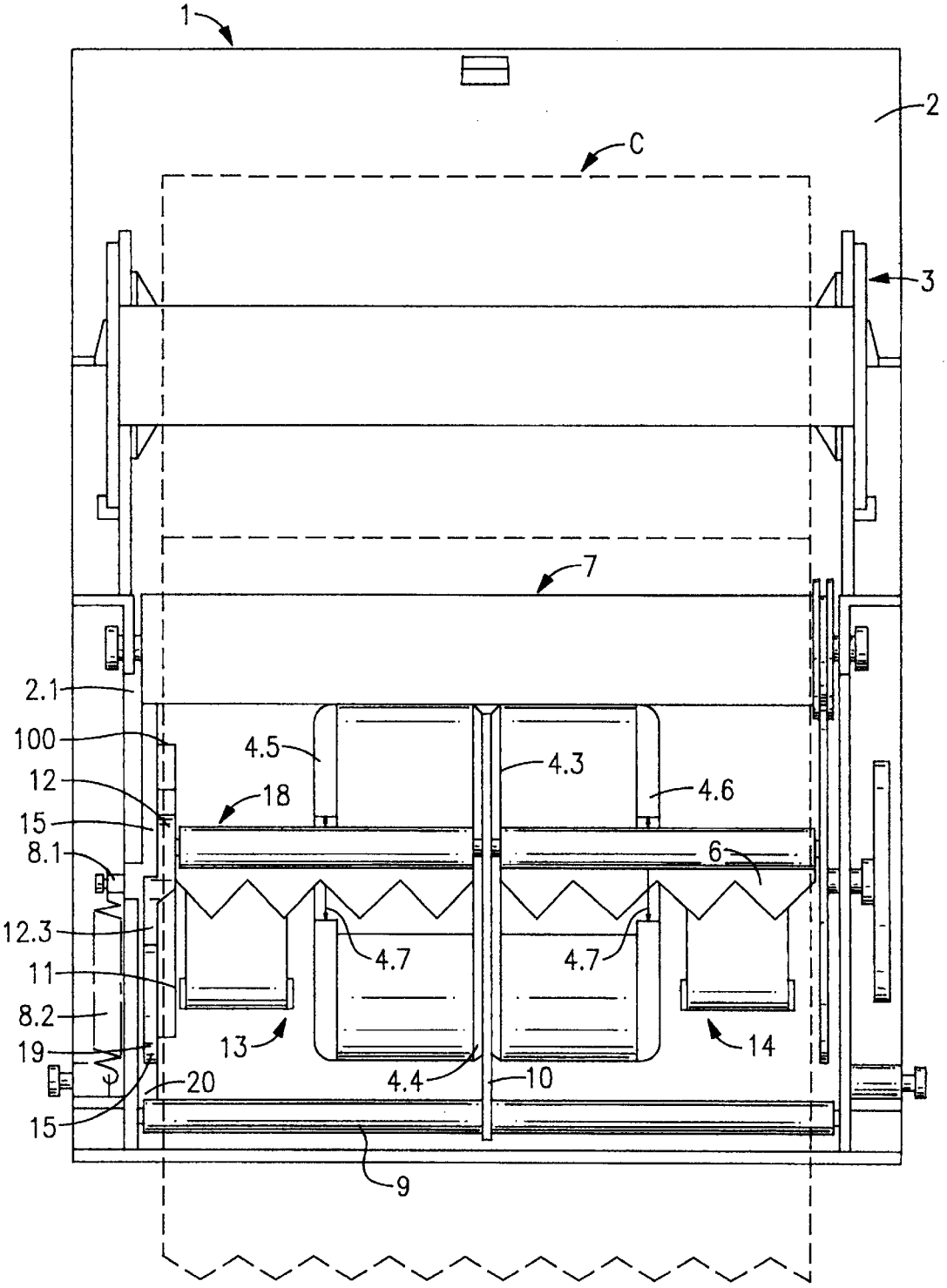
FIG. 2 is a front view of the apparatus according to FIG. 1.

According to the specifications, this invention is an automatic dispenser of hand-towels, toilet paper or folded lengths of paper such as napkins. The complete apparatus is shown in FIG. 1. Generally, the dispenser 1 requires eight components in total. The dispenser components include a molded plastic housing 2 with molded reel-holder device 3, a protective cover 5, a drum 4, a paper cutoff device 6, a tensioning device 7, means 8 of actuating and reversing the drum comprising an eccentric level 8.1 and a spring 8.2, and where necessary, a protective reel 9 and a drive belt 10. As shown in FIGS. 1 and 4–6, when a towel is pulled from the dispenser, the drive belt 10 facilitates movement of the drum and blade and advancement of the paper roll. As shown in FIGS. 1 and 2, the drive belt 10 is also responsible for holding the parts encompassed by the belt in fixed relation to each other. Such a means of actuating and reversing via the eccentric lever is well-known in the art. For instance, see col. 3, lines 1–20, of U.S. Pat. No. 3,998,120 to the applicant. More particularly, the apparatus comprises a molded plastic housing 2 the upper part of which is designed to receive a reel-holder device 3 for a reel C of towel, toilet or napkin paper; a protective cover 5 that is positioned and hinged by a drum support 4; a paper cutoff device 6 and a tensioning device 7 for feeding the paper band from a reel C of towel to the drum on the one hand and taking up the slack of the paper band on the other. The movement of the knife holder 18 towards the drum, to cut the paper band, is obtained by a molded cam 11 with a plurality of radiating fingers mounted on the inside of and onto one of the sides 2.1 of the housing 2, and a heel-shaped pinion 12 associated with the knife holder 18. The cam 11 and the heel-shaped part 12 work together as a gearing mechanism. The paper cutoff device 6 can be moved using the mechanisms and arrangements described in French patent applications 93/04082, and 93/14609. A protective cover protects the mechanisms referred to and the paper band to be dispensed. The protective cover is located at and hinges on the base of the housing of the apparatus. The protective cover is locked in place using a locking tongue located in the upper part of the housing or another equivalent locking system.

The drum can be of the type described in French patent applications 93/04082, 93/14609, and 94/09924. In particular, in a preferred embodiment shown in FIG. 2, the drum comprises an internally hollow shaft of small diameter. The middle part of the actual shaft itself accommodates a spacer disc 4.3 having a peripheral groove 4.4 to accommodate the drive belt 10. On either side of this disc there are rings 4.5, 4.6, of the same width, and of a diameter equivalent to that of the drum. These rings are discontinuous and define a slot between their ends 4.7. This slot allows for movement and hinging of the knife holder 18 as described in French patent applications 93/04082, and 93/14609.

According to the invention, the dispenser is designed with means which locks the knife holder 18 in position in the transverse slot of the drum during phases of non-operation.

Figure 3A:
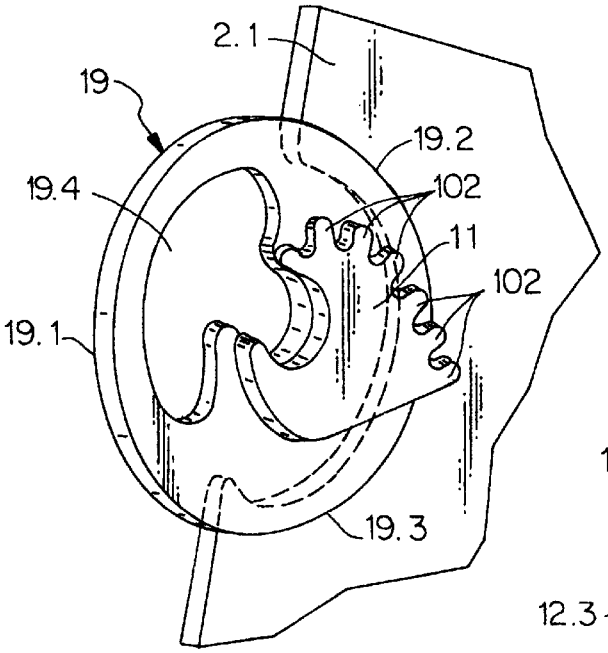
Figure 3B:
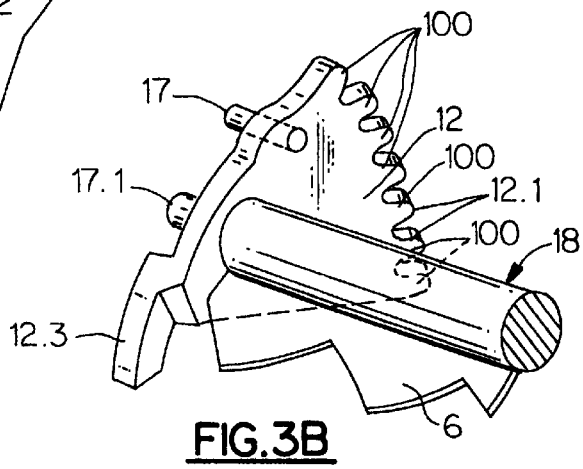
Figure 3C:
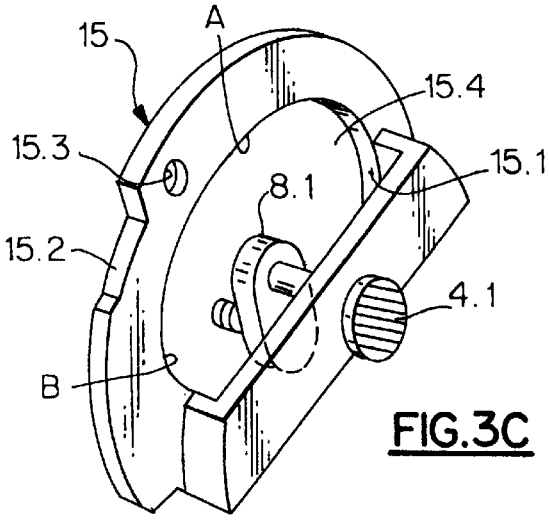
Figure 4:
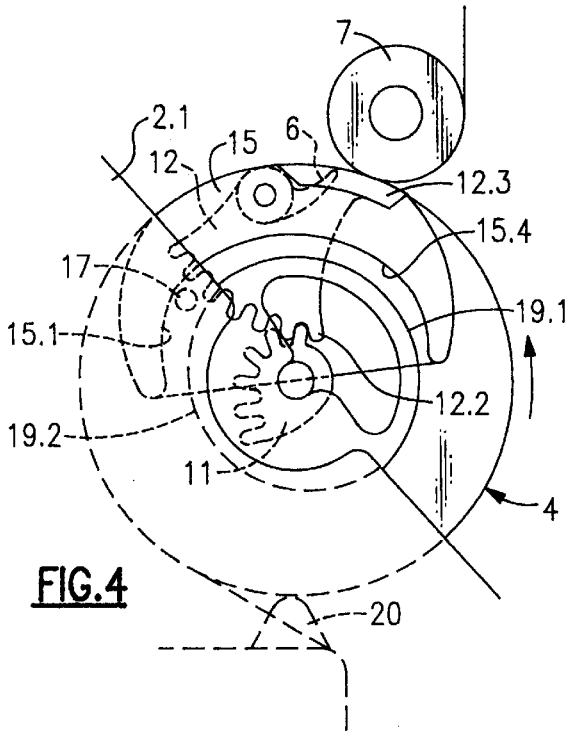
FIGS. 4, 5 and 6 are schematic views showing the various positions of the knife during one rotation cycle of the drum with use of the means that are the subject of the invention.
Figure 5:
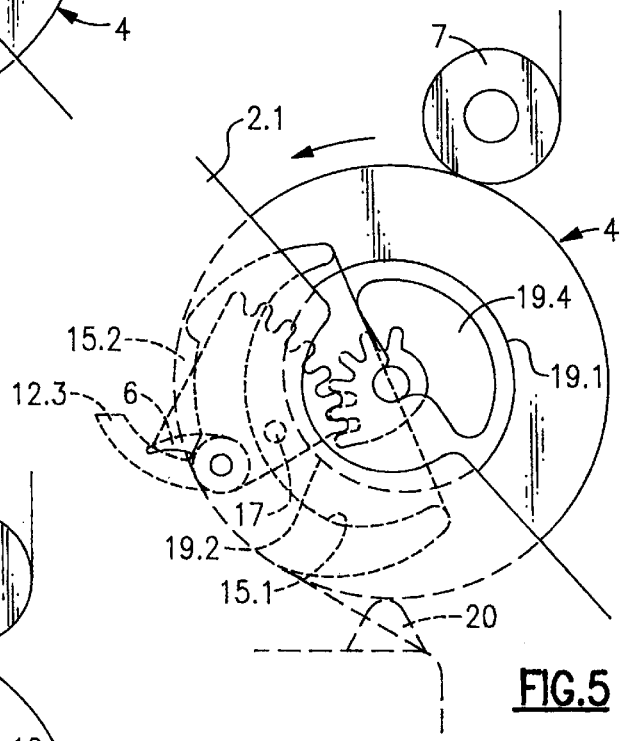
Figure 6:
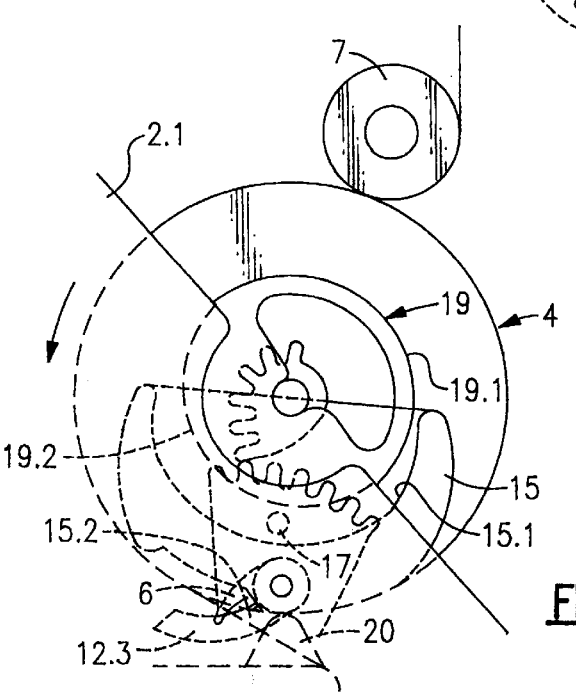

As illustrated in FIGS. 4–6, the non-circular profiled disc 19 actually fits inside the cut out portion of the end flange 15. Moreover, and as shown in FIGS. 3B and 3C, the heel-shaped pinion 12 also includes a projection 17.1 that is inserted through the hole 15.3 located on the end flange 15. By inserting the projection 17.1 through the hole 15.3, the heel-shaped pinion 12 is mated to the end flange 15, thereby allowing the blade 12 to rotate while being fixed relative to said end flange 15.

As shown in FIGS. 2–5, the heel-shaped pinion 12 has an external perpendicular finger 17 formed thereon. The heel-shaped pinion 12 is fixed on the lateral side 2.1 of the housing 2, (see FIG. 2). The external perpendicular finger 17 is situated essentially opposite the first tooth 12.2 of pinion 12. The cam 1 interlockingly and rotatably cooperates with a plurality of interlocking fingers 100 provided on the heel shaped pinion 12, causing the knife holder 18 to swivel. As the knife holder 18, FIG. 3B swivels, the external finger 17 eventually contacts with either of opposing first and second limit stop areas A and B during the extreme retraction and ejection movements of the knife, respectively.

As shown in FIGS. 3A, 3B, 3C and 4–6, the external perpendicular finger 17 is guided between the region formed between the inner surface of the internal opening 15.1 of the end flange 15 and the outer peripheral edge 19.1 of the non-circular profiled disc 19. The internal opening defined by the surface 15.1 is designed to permit free clearance and guidance of the finger 17 during rotation of the drum 4, FIG. 2.

As shown in FIG. 5, from the heel-shaped pinion 12 extends an offset tip 12.3 capable of being aligned with flange 15 that supports the knife holder 18. The flange has a notch 15.2 for accommodating the tip 12.3 so that when the knife is fully retracted the tip fits into the notch in the flange to ensure peripheral continuity. The limit stop area B of finger 17 is essentially underneath the notch 15.2.

Figure 7:
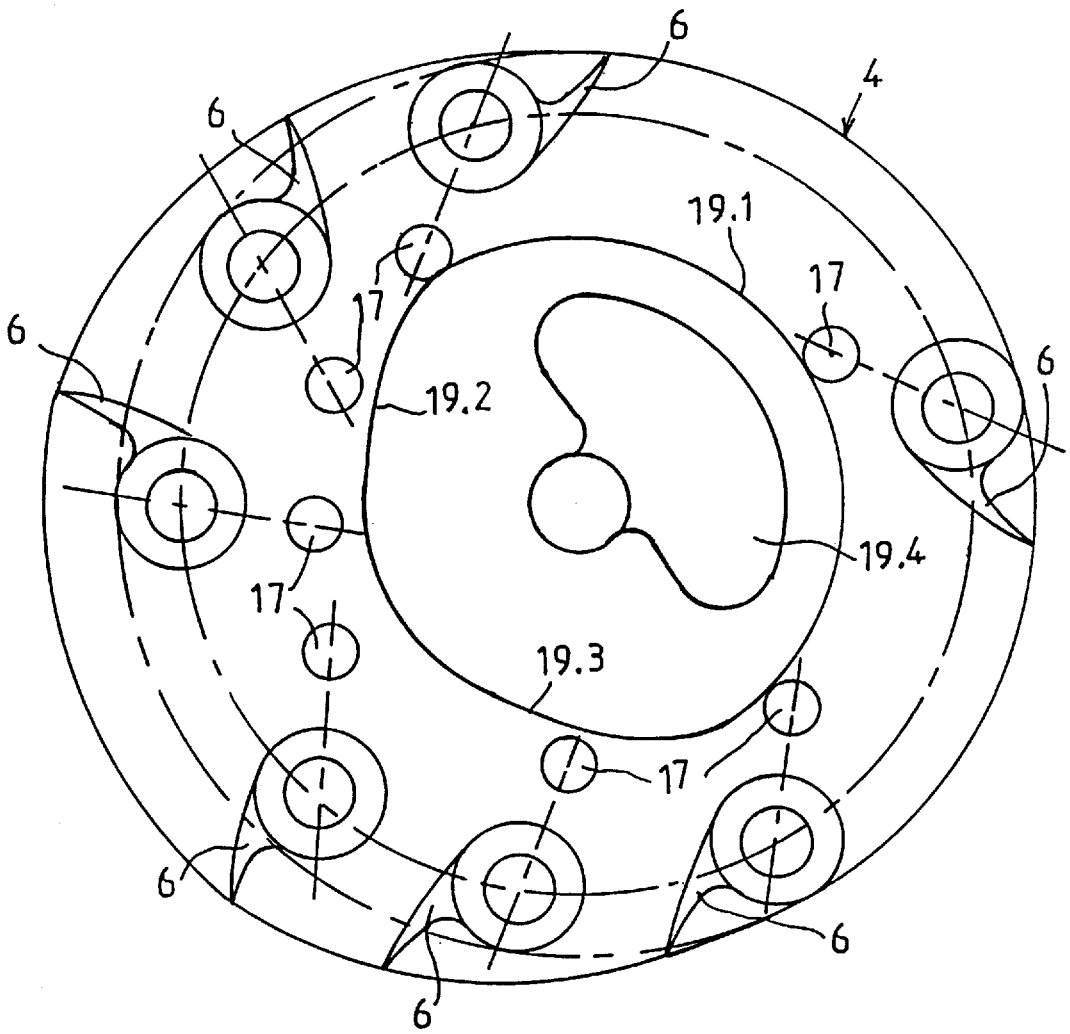
FIG. 7 is a view showing the trajectory of the knife and the guiding plane during operation of the apparatus according to the invention.

At the same time, the lateral side 2.1 of the housing 2 has a non-circular profiled disc 19 molded to the cam 11 with a plurality of radiating fingers 102. As shown in FIGS. 1, 2 and 3A, the lateral side 2.1 of the housing 2 is the side of the housing which includes a support ramp 20. This cam 11 assists to move the externally perpendicular finger 17 relative to the heel-shaped part 12. The cam 11 projects laterally from the disc as shown in FIG. 1 and 3*a*. As shown in FIG. 7, this disc has a special external profile with three characteristic areas which correspond to different phases of operation and rotation of the drum over one revolution.

During the non-operating phase of the dispenser, the knife 6 is secured in the recess of the drum. This occurs because the finger 17 is secured laterally (i.e., lateral movement is prevented) between the outer profile of the first circular area 19.1 and the inner edge of the flange 15.1. Approximately 160° of this first area 19.1 acts as a support area for the finger 17.

The second oval-profiled area 19.2 comprises an angular sector of approximately 90° in the upper left rear portion of the disc.

Along the second area of the disc, finger 17 has contact with neither the second area 19.2 nor the internal opening of the flange of the drum holder 18. That is, the second area 19.2 does not retain or guide the finger 17. When the finger is positioned along the second area of the disc, this corresponds to meshing of the pinion with the cam which starts the ejection phase of the knife. This happens when the notch 15.2 is engaged with the tip 12.3.

The third non-circular area 19.3 of the disc begins after the area where the tip comes into contact with the horizonal ramp 20 on the base of the housing. This third area ends where it joins the first area. Once the tip comes into contact with the ramp formed on the base of the housing, the finger 17 is secured so that it moves laterally with and between the disc and the flange of the drum. This starts the retraction phase. Consequently, the knife holder 18 is retracted as the tip retracts into the recess as it is subjected to a backward movement after coming in contact with the ramp.

The overall configuration of the disc ensures continuity as far as the plane corresponding to stopping the drum during non-operative periods.

Internally, the disc has a profiled cutaway 19.4 shaped to allow clearance for and insertion of eccentric lever 8.1 arranged at the end of the shaft of the drum.

The horizontal plane in the lower part of the housing includes a support ramp 20 along the lateral side of the housing. The external part of the tip 12.3 comes into contact with the support ramp 20 during rotation of the drum. This starts the retraction phase in which the knife holder 18 moves inside the opening formed on the flange of the drum.

During the ejection phase of the knife holder 18, the disc and the end flange of the drum are designed so that during rotation of the drum it is possible to secure the finger or release it, thus making it possible to hinge the knife holder 18 freely or secure it. The finger is secured by bringing the end flange and disc together, and the finger is released by distancing the end flange and disc.

The operation of the mechanism is now described, reference being made to FIGS. 1, 4 to 7.

FIG. 1 shows the drum in the stop position. The cam 11 has not meshed with the heel-shaped pinion 12. The separately mounted finger on the heel-shaped pinion is blocked and moves laterally between the disc and the internal opening of the flange. This is the non-operating phase where the disc functions only in the first area. The tip is fully retracted in the opening of the flange and the knife is retracted in the transversal slot in the drum.

FIG. 4 shows the drum at the start of the rotation phase after a paper band has been pulled by the user. In this phase, the first tooth of the heel-shaped pinion 12 which is associated with the knife holder 18, starts to mesh with the first tooth formed on the cam which is fixed on the lateral side of the housing. In this phase, the separately mounted finger 17 on the heel-shaped pinion 12 escapes the guidance between the lateral flange of the drum and the disc. However, the knife holder 18 remains retracted because the tip is in contact with the end disc of the tensioning device 7.

The operating phase shown in FIG. 5 corresponds to ejection of the knife from behind the tensioning device, obtained by increasing the inter-meshing between the cam and the heel-shaped pinion. In this phase of operation, the finger is free relative to its initial support and retention areas. The finger is no longer in contact with the profile of the disc, thus allowing complete ejection of the knife holder 18. Also note that the tip is in a raised and ejected position with respect to the flange of the drum.

FIG. 6 shows the phase of gradual retraction where the cam disengages from the heel-shaped pinion. Consequently, gradual retraction of the knife holder 18 is caused as the tip comes into contact with the horizontal ramp formed on the housing. The finger remains free with an area of maximum clearance from the walls of the internal cavity formed between the flange and the profile of the disc. The ramp allows the finger to move closer to the internal profile of the disc whereas the retraction area of the flange of the drum tends to gradually cover, as it rotates, the front external profile of the disc. The finger is once again laterally secured between the disc and the flange of the drum. This ensures retention of the knife holder 18 inside the recess in the drum. The special-purpose profile of the disc creates a cam effect.

Advantageously, these arrangements ensure completely safe operation since the knife holder 18 cannot accidentally emerge from its recess. The arrangement of the tip opposite the finger with respect to the end flange allows such a function. The accuracy and complete safety of the gearing mechanism (cam and heel-shaped pinion), provides another significant improvement over prior designs.

The mechanism can be applied to the drum in its various alternative embodiments because the drum is adapted on the end flange having the toothed part of the heel-shaped pinion which cooperates with the cam. The drum may therefore be produced in several modular parts as described in French patent application 94/09924, or in one piece as described in French patent applications 93/04082, and 93/14609.

The advantages of the invention are clearly apparent and, in particular, the high degree of safety achieved by the apparatus by eliminating any risk of injury to operators is emphasized. The mechanisms described by the invention can easily be adapted when molding the various components of the apparatus without incurring any additional cost. Assembly is also fast. In addition, the means of locking the knife holder 18 in the drum can be used in a folded/unfolded paper towel dispensing apparatus in accordance with the characteristics defined in the above-mentioned French Patents.

While the present invention has been particularly shown and described with reference to the preferred mode as illustrated in the drawings, it will be understood by one skilled in the art that various changes in detail may be effected therein without departing from the spirit and scope of the invention as defined by the claims.

I claim:

1. A paper towel dispensing apparatus, comprising:

a protective housing having a lower part and an upper part, said apparatus including a drum supporting a paper cutoff device, and a tensioning device in said lower part, wherein the upper part of said housing includes lateral flanges capable of accommodating reel-holding means for supporting and feeding a reel of paper material a portion of which is threaded along a paper travel path extending between said drum and said tensioning device, said tensioning device having means for applying pressure against said drum and allowing transport of a paper band of material from said reel of paper material along said paper travel path for purposes of dispensing and ejecting said paper band of material as pulled by a user from the lower part of said housing; said paper cutoff device being hinged relative to the drum to ensure cutting of the paper band of material when pulled by said user, wherein said drum is rotated within the lower part of said housing via an actuating and reversing means which comprises a spring and eccentric lever;

a cam with a plurality of radiating fingers, fixedly attached to a lateral, interior portion of the housing, said cam interlockingly cooperating with a heel-shaped pinion and being associated with a knife holder to ensure ejection of a knife from the drum upon rotation, wherein the heel-shaped pinion includes a projecting finger, said finger being guided by an internal periphery surface of an end flange of the drum, wherein said heel-shaped pinion includes an offset tip capable of being aligned with the end flange of the drum, said offset tip fitting temporarily in a notch on an external peripheral surface of the drum end flange during a stop position of the apparatus, wherein the fixed cam acts as a guide for the finger of the heel-shaped pinion by locking the knife holder in a recess of the end flange of the drum while the apparatus is in the stop position;

a first stop limit located on the internal peripheral surface of the end flange of the drum, wherein said knife is locked in said stop position when the finger is positioned at the first stop limit;

a second stop limit located on the internal peripheral surface of the end flange of the drum, wherein said knife is located in a pre-ejection position while the finger is positioned at the second stop limit; and a horizontal support ramp placed on a base of the housing which cooperates with the knife to ensure swivelling and retraction of the knife into the recess formed on the end flange of the drum.

2. A paper towel dispensing apparatus according to claim 1, wherein said finger and the offset tip of said heel-shaped pinion are oppositely positioned relative to the end flange of the drum thus defining the first and second stop limits, said stop limits stopping the finger along the internal peripheral surface of the end flange during a restriction phase and an ejection phase of the knife, respectively.

3. A paper towel dispensing apparatus according to claim 2, wherein said disc has a profiled internal opening which allows insertion of the eccentric lever associated with a shaft of the drum.

4. A paper towel dispensing apparatus according to claim 2, further including a non-circular profiled disc, said disc areas including:

a first circular area covering a sector of approximately 160° of said disc and constituting a support area for said finger, said first area partially securing the finger during the restriction phase of the knife;

a second oval-shaped area situated towards a rear section of the disc and covering a sector of approximately 90° of said disc, said second area partially securing the finger during the ejection phase of the knife in which the pinion meshes with the cam; and a third non-circular connecting area, which partially secures the finger and operates during a retraction phase of the knife after the offset tip comes in contact with the horizontal support ramp formed on the base of the housing, thereby causing said knife to move into said recess of said drum, each of said areas of said disc corresponding to different phases of operation occurring during one revolution of said drum.

5. A paper towel dispensing apparatus according to claim 4, wherein inter-meshing between a first tooth of said cam and said heel-shaped pinion starts a rotation phase after said paper band of material is pulled by said user, said rotation phase causing the heel-shaped pinion to mesh with said cam, causing the finger on said heel-shaped pinion to escape guidance between the end of the drum and said disc, and ending the restriction phase of said knife.

6. A paper towel dispensing apparatus according to claim 4, wherein increased inter-meshing between said cam and said heel-shaped pinion releases said finger from a profile of said disc, thereby allowing complete ejection of said knife from the recess near said tensioning device.

7. A paper towel dispensing apparatus according to claim 4, wherein said cam disengages said heel-shaped pinion causing said offset tip to come into contact with the horizontal support ramp thereby causing retraction of said knife into the recess of the drum and securing of the finger between the disc and the flange of the drum.

8. A paper towel dispensing apparatus according to claim 4, wherein said non-circular profiled disc rotates to transform rotary motion of the drum into linear motion of the paper band.

* * * * *